US008398129B2

(12) United States Patent
Hale et al.

(10) Patent No.: US 8,398,129 B2
(45) Date of Patent: Mar. 19, 2013

(54) TOTE BOX SEAL

(76) Inventors: Ryan Hale, Brooklyn, NY (US); Brian Lyle, Somers, NY (US)

( * ) Notice: Subject to any disclaimer, the term of this patent is extended or adjusted under 35 U.S.C. 154(b) by 719 days.

(21) Appl. No.: 12/581,204

(22) Filed: Oct. 19, 2009

(65) Prior Publication Data

US 2011/0089176 A1 Apr. 21, 2011

(51) Int. Cl.
*B65D 27/30* (2006.01)
*B65D 33/34* (2006.01)

(52) U.S. Cl. ..... 292/307 R; 292/307 A; 292/307 B; 292/318

(58) Field of Classification Search ..... 292/307 R, 292/307 A, 307 B, 308–327
See application file for complete search history.

(56) References Cited

U.S. PATENT DOCUMENTS

| | | | | | |
|---|---|---|---|---|---|
| 4,075,742 | A | * | 2/1978 | Remark et al. | 24/453 |
| 4,588,218 | A | * | 5/1986 | Guiler et al. | 292/307 R |
| 4,690,443 | A | * | 9/1987 | Brammall | 292/307 R |
| 4,694,781 | A | * | 9/1987 | Howe et al. | 119/655 |
| 5,005,883 | A | * | 4/1991 | Guiler | 292/327 |
| 5,056,837 | A | * | 10/1991 | Fuehrer | 292/307 R |
| 5,120,097 | A | * | 6/1992 | Fattori et al. | 292/318 |
| 5,125,700 | A | * | 6/1992 | Fattori et al. | 292/318 |
| 5,127,687 | A | * | 7/1992 | Guiler | 292/327 |
| 5,522,627 | A | * | 6/1996 | Swift | 292/319 |
| 5,568,952 | A | * | 10/1996 | Ruegg | 292/318 |
| 5,725,261 | A | * | 3/1998 | Rahn | 292/307 R |
| 5,732,989 | A | * | 3/1998 | Stevenson et al. | 292/327 |
| 5,884,949 | A | * | 3/1999 | Leon et al. | 292/318 |
| 6,962,376 | B2 | * | 11/2005 | Palzkill et al. | 292/327 |
| D514,425 | S | * | 2/2006 | Hamilton et al. | D8/331 |
| D548,041 | S | * | 8/2007 | Littrell et al. | D8/331 |
| 7,360,806 | B2 | * | 4/2008 | Ching | 292/307 R |
| D568,716 | S | * | 5/2008 | Littrell et al. | D8/331 |
| D592,038 | S | * | 5/2009 | Littrell et al. | D8/331 |
| 7,721,407 | B2 | * | 5/2010 | Littrell et al. | 29/509 |
| 7,740,292 | B1 | * | 6/2010 | Fattori et al. | 292/307 R |
| 2006/0266087 | A1 | * | 11/2006 | Hamilton et al. | 70/91 |

FOREIGN PATENT DOCUMENTS

EP 537400 A1 * 4/1993

* cited by examiner

*Primary Examiner* — Carlos Lugo
(74) *Attorney, Agent, or Firm* — Malina & Associates, PLLC

(57) ABSTRACT

A seal for tote boxes includes a post member of extended length which has an enlarged end portion and a housing which has locking fingers which flex to accept the enlarged end of the post member and then lock to prevent removal of the post member. The housing includes a pair of upwardly projecting flanges, and a downwardly projecting flange. When installed on tote box the upwardly projecting flanges maintain the position of the downwardly projecting flange so that it is visible past the handle of the tote box allowing visual access to indicia on the downwardly projecting flange and allowing an authorized user to cut the post portion to remove the seal.

14 Claims, 10 Drawing Sheets

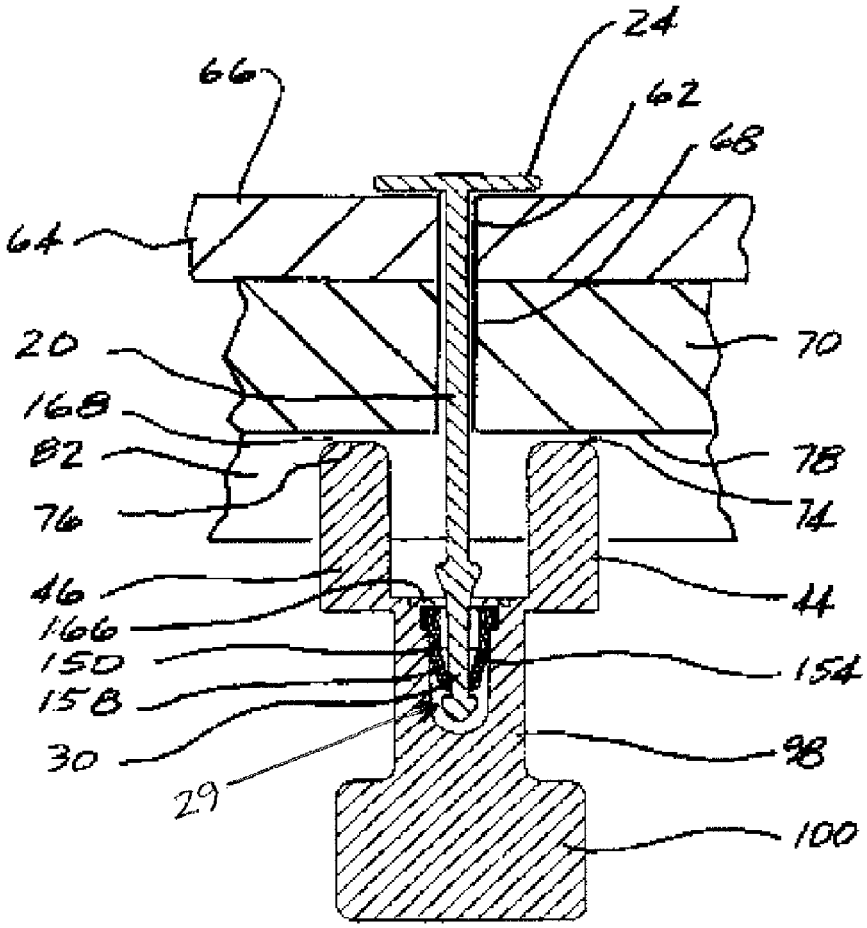
FIG. 9
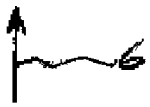

TOTE BOX SEAL

FIELD OF THE INVENTION

The present invention relates generally to the field of security seals and more particularly to a tote box seal.

BACKGROUND OF THE INVENTION

The increased use of large scale automated distribution centers in many product distribution channels has led to an associated increase in the use of complex conveyor belt systems which include conveyor belts of extended length and various types of rotary transfer tables which are used to transfer goods within the distribution center facility. In a typical application various goods, which can range from high value medicines or jewelry to a variety of consumer products, are typically stocked in bins in various locations and must be transferred within the distribution center facility for purposes of quality control, checking and shipment. These goods are typically loaded into tote boxes which are sealed to prevent pilferage and damage.

The tote boxes usually include projecting flanges having holes and integrally formed handles. The prior art seals used on tote boxes are usually of the type known as shackle seals which include a lockbody with an attached strap or bail. The strap passes through holes in the tote box flanges and extends around the outer edge of the flanges. An end of the strap snaps into the lockbody thereby forming a seal.

A disadvantage of prior art seals is breakage during transit as a result of stacking and unstacking of the tote boxes and random rubbing contact between tote boxes during transit.

In event of a broken seal the entire contents of the tote box must be checked for pilferage or possible tampering. This results in lost time which is costly and which can adversely impact delivery schedules.

In addition, the strap of the prior art strap seals may become ensnared in the conveyor belt equipment creating a jam condition resulting in potential damage to the goods in the tote box and unwanted down-time for the distribution system until the jam condition is cleared. Even in cases where the strap does not become ensnared in the conveyor system, the exposed strap may rub against exposed portions of the conveyor system, become frayed and break.

The prior art strap seals typically include a flag portion which carries informational data related to the contents of the tote box. In order to function properly, the strap portions are made flexible to facilitate bending around the edges of the tote box straps and as a result, the flag portions can fall into an area which is relatively inaccessible or difficult to read. In the event of a seal failure, the exposed flag portion may become lost and the entire contents and the intended destination of the tote box must be re-identified resulting in unwanted loss of time and added expense.

As a result of the various difficulties associated with the prior art seals used on tote boxes, there is a need for an effective, inexpensive and reliable tote box seal.

OBJECT AND SUMMARY OF THE INVENTION

It is an objective of the present invention to provide a tote box seal which can be used to seal tote boxes in a simple, inexpensive and reliable manner.

Another objective of the present invention is to provide a tote box seal which does not rely on the use of a flexible strap or bail.

Another objective of the present invention is to provide a tote box seal which includes a flag portion for descriptive indicia which is not subject to damage or breakage during transportation by conveyor equipment.

Another objective of the present invention is to provide a tote box seal on which any tampering is readily evident.

Another objective of the present invention is to provide a tote box seal having a flag portion which remains easily visible at all times when the tote box seal is attached to the flanges of a tote box.

Another objective of the present invention is to provide a tote box seal having a small number of component parts which can be manufactured economically in volume resulting in a relatively low unit cost.

In accordance with the present invention, there is provided a tote box seal which comprises a post member and a housing member. The post member includes an elongated portion having a cap on a first end, a bulbous portion on a second end and an intermediate portion having a reduced transverse dimension relative to the bulbous portion. The housing member includes a locking member which has flexible resilient locking fingers which accept, retain and lock the post member after the second end of the post member is pushed past the locking fingers. The housing member includes a base portion, a pair of upwardly projecting flanges and a downwardly projecting flange. The downwardly projecting flange remains vertically oriented and visible when the tote box seal is attached to a tote box and may be used to carry indicia related to the contents and destination of the tote box. The locking member is made of a heat resistant plastic which resists tampering by unauthorized insertion of a heated object. The locking member is mounted in a cavity formed in the housing member and is retained by a bead which is thermally formed on the housing member.

These and other objects and advantages of the present invention will become apparent from the following description of the preferred embodiment taken in conjunction with the following drawings, although variations and modifications may be made without departing from the spirit and scope of the novel concepts of the disclosure.

BRIEF DESCRIPTION OF THE DRAWINGS

FIG. 9 is a cross-sectional view taken along the line 9-9 of FIG. 7;

DETAILED DESCRIPTION OF THE INVENTION

Figure 1:
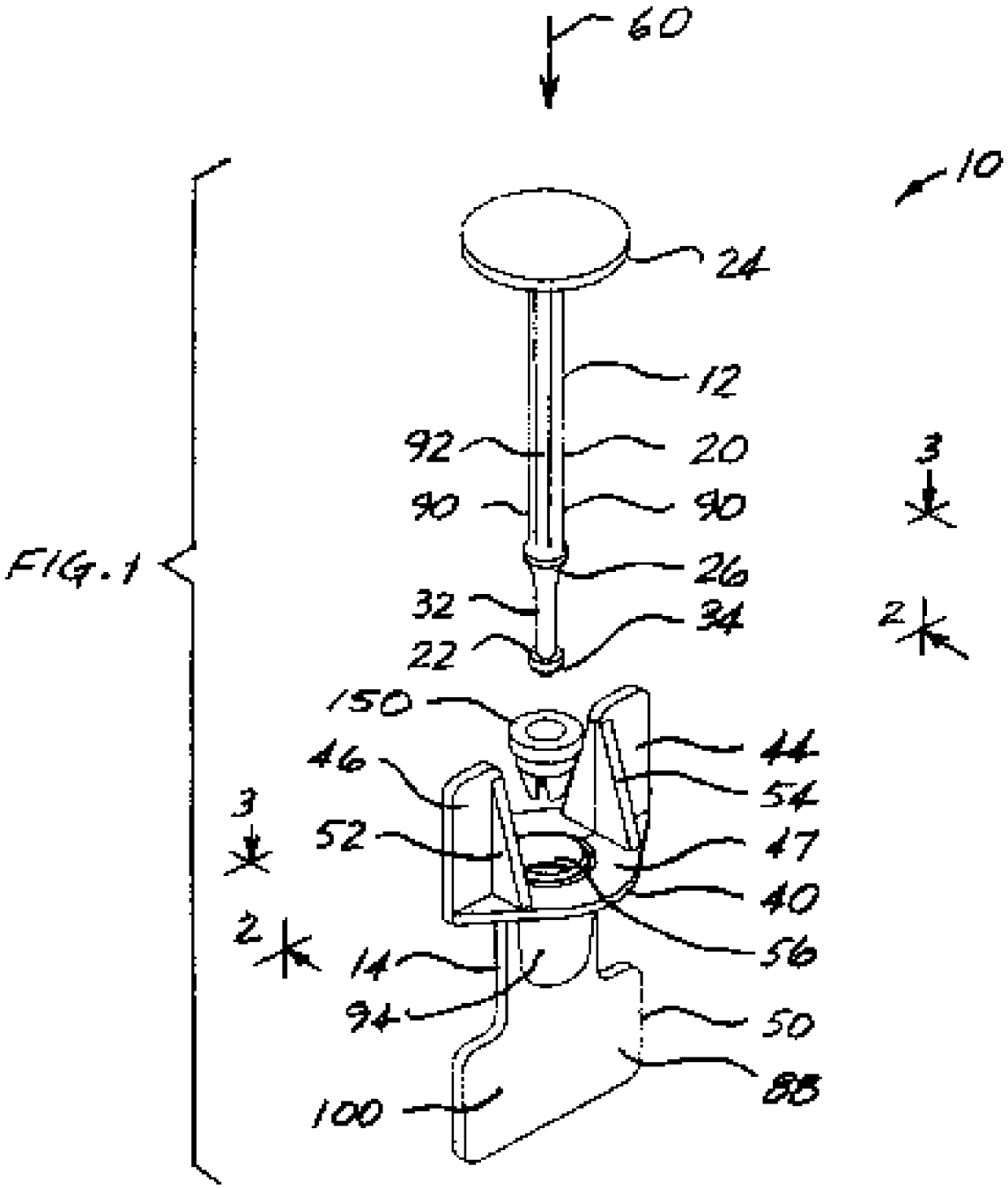
FIG. 1 is a vertical exploded perspective view of a tote box seal in accordance with the present invention.
Figure 2:
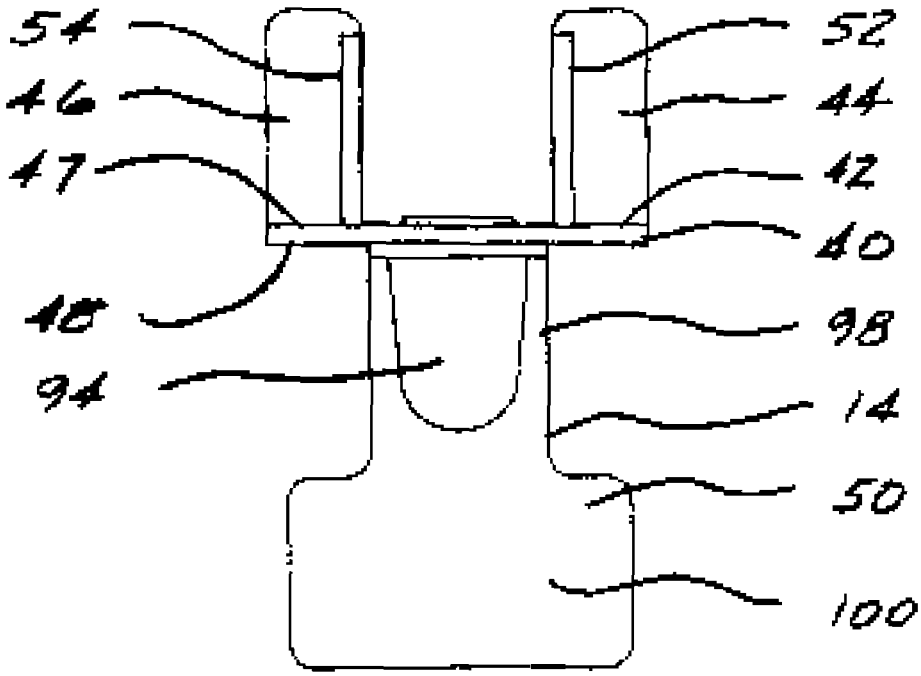
FIG. 2 is an elevation view of the housing of the tote box seal taken along the line 2-2 of FIG. 1.
Figure 3:
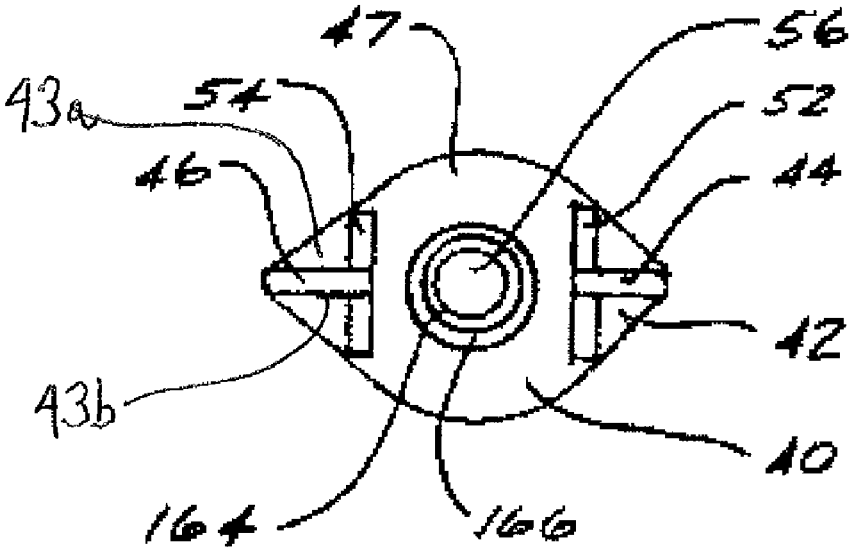
FIG. 3 is a plan view of the housing of the tote box seal taken along the line 3-3 of FIG. 1.

With reference to the drawings there is shown in FIGS. 1-10 a tote box seal 10 made according to the present invention which comprises a post member 12 and a housing member 14.

The post member 12 is an elongated unitary member having a body portion 16 with a first end 18, an intermediate portion 20 and a second end 22. A relatively thin flat generally cylindrical cap portion 24 is formed on the first end 18. A frusto-conical transition portion 26 having a relatively narrower portion 28 and a relatively wider portion 30 is formed on the intermediate portion 20. The relatively wider portion 30 is disposed facing the cap portion 24. The intermediate portion 20 has cross-like or X-like cross-section formed by intersecting flanges 90, 92. The X-like cross-section of the intermediate portion 20 results in a relatively light weight structural element which combines relatively great stiffness and resistance to bending with economical use of material.

Figure 6:
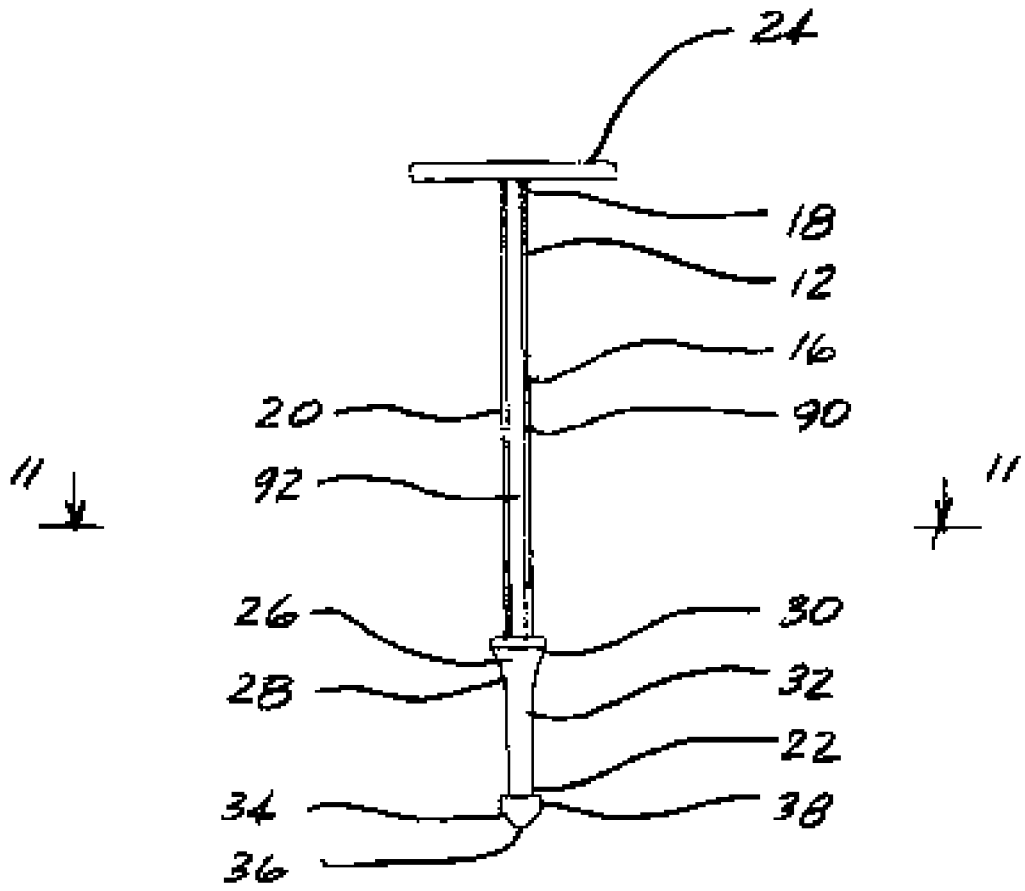
FIG. 6 is an elevation view of the post member of the tote box seal of FIG. 1 taken along the line 6-6 of FIG. 1.

A relatively shorter and generally cylindrical portion 32 is disposed between the narrower portion 28 of the frusto-conical portion 26 and the second end 22. The second end 22 includes an enlarged end portion 29 with an embodiment which is a generally bulbous portion 34 which has a rounded end 36 and a relatively short generally cylindrical portion 38 which have a common diameter which is greater than the diameter of the portion 32 as is best shown in FIGS. 1 and 6.

Figure 4:
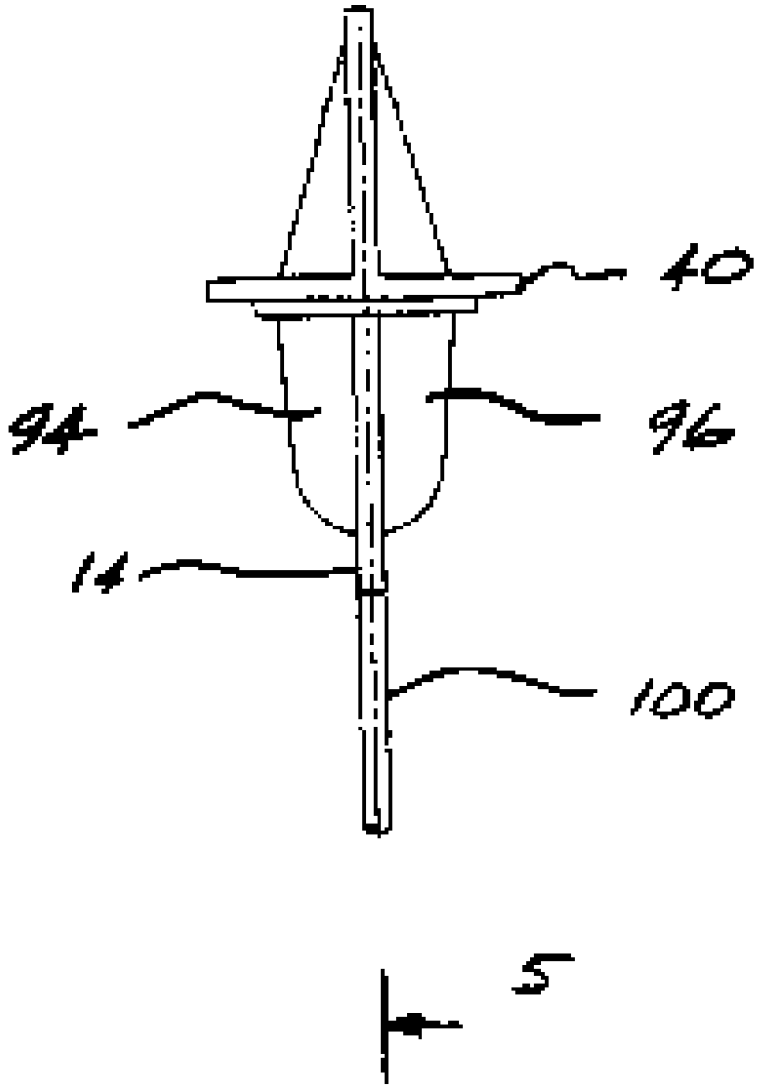
FIG. 4 is an elevation view of the housing of the tote box seal taken along the line 4-4 of FIG. 1.
Figure 5:
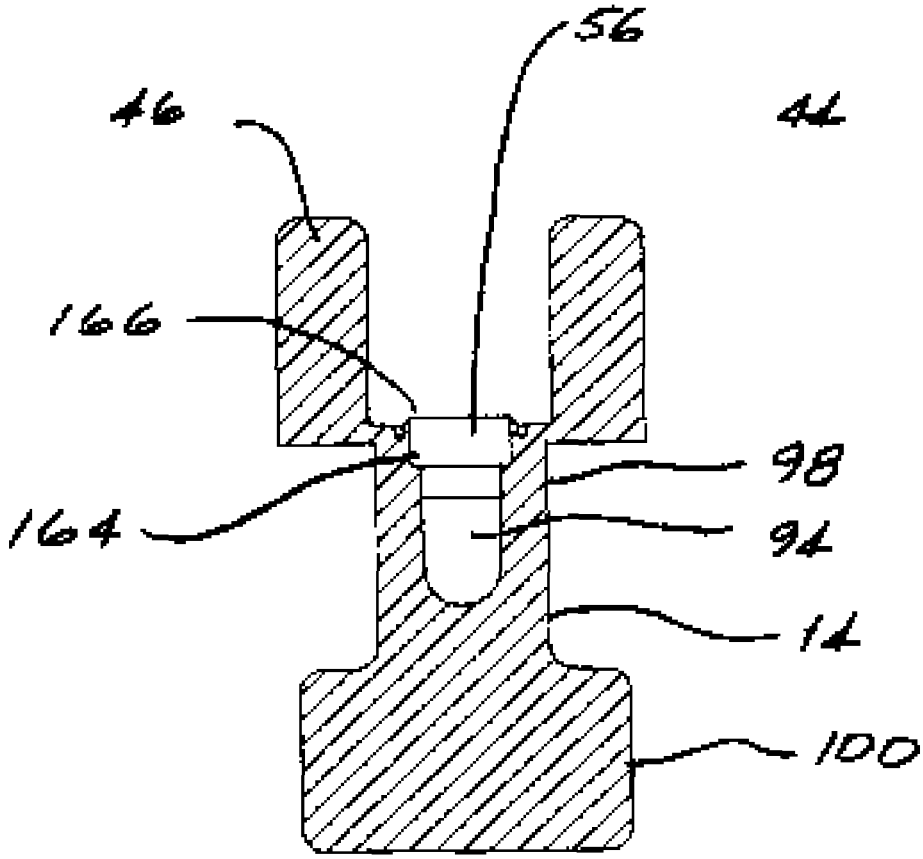
FIG. 5 is a cross-sectional view of the housing of the tote box seal taken along the line 5-5 of FIG. 4.

The housing member 14 includes a generally diamond-shaped base portion 40 which has a top surface 47 with a pair of upwardly directed spaced apart flanges portion 44 and 46 and a bottom surface 48 with a single downwardly directed and generally centrally disposed flange portion 50. Each flange is defined by a first major surface 43*a* and a second major surface 43*b* which are opposite one another. Each of the upwardly directed flanges 44 and 46 has a stiffener portion 52 and 54 which projects upwardly from the top surface 42. The stiffener portions 52, and 54 are generally triangular. The combination of the upwardly directed flanged portions 44 and 46, with each flange portion 44 and 46 having a stiffener portion 52 and 54 respectively, provides an extremely rigid yet lightweight structure in which the flange portions 44 and 46 and the back portions 40 are light in weight yet highly resistant to bending. The housing member 14 includes cup-like portions 94 and 96 which are formed below the base portion 40 as shown in FIG. 4.

Figure 10:
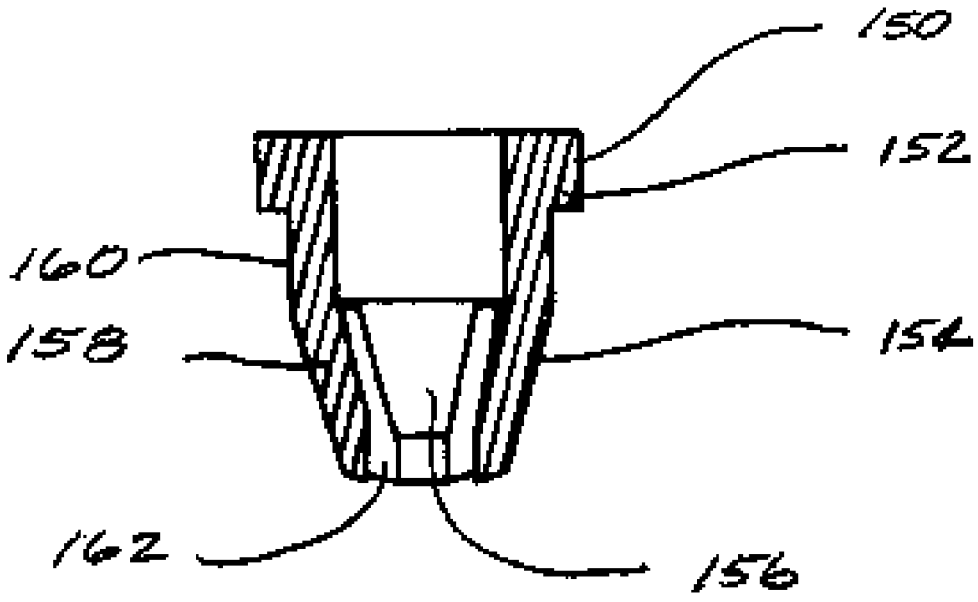
FIG. 10 is a longitudinal cross-sectional view of the locking member of the tote box seal.
Figure 11:
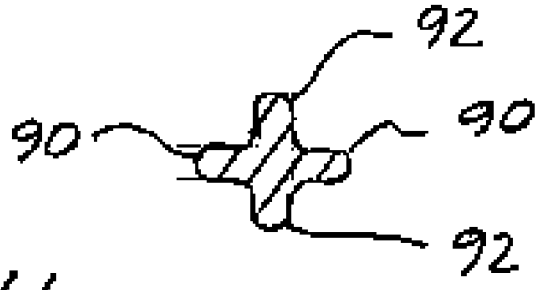
FIG. 11 is a cross-sectional view taken along the line 11-11 of FIG. 6.

The base portion 40 has a central counterbored cavity 56 which accepts a locking member 150. The locking member 150 forms a key feature of the tote box seal 10. The locking member 150 as is best shown in FIG. 10 includes a base ring portion 152 and three downwardly projecting locking fingers 154, 156 and 158 which project from the collar portion 160. The locking fingers 154, 156 and 158 define a restricted passage 162.

In the preferred embodiment of the invention 10, the housing member 14 is made of a thermally formable plastic such as polypropylene and the locking member 150 is made of a thermally resistant plastic such as nylon. During assembly, the locking member 150 is inserted in the counterbore 164 and a locking bead 166 is thermally formed over the base ring portion 152 using suitable conventional heat forming tooling as shown in FIG. 9 to permanently lock the housing member 14 and the locking member 150 together.

The locking fingers 154, 156 and 158 are disposed to flex and accept the bulbous portion 34 of the post member 12 when the post member 12 is pushed into the central aperture 56 in the direction indicated by the arrow 60 in FIG. 1. Once the locking fingers 154, 156 and 158 snap past the bulbous portion 34, they contact the portion 32 of the post 12 and the post 12 cannot be separated from the housing member 14. In order to separate the post 12 from the housing member 14, the post 12 must be cut apart creating obvious signs of tampering and damage.

The housing 12 includes a relatively narrower portion 98 located above the flag portion 100. Access to the locking fingers 154, 156 and 158 is prevented by the cup-like portions 94 and 96 thereby preventing tampering.

Figure 7:
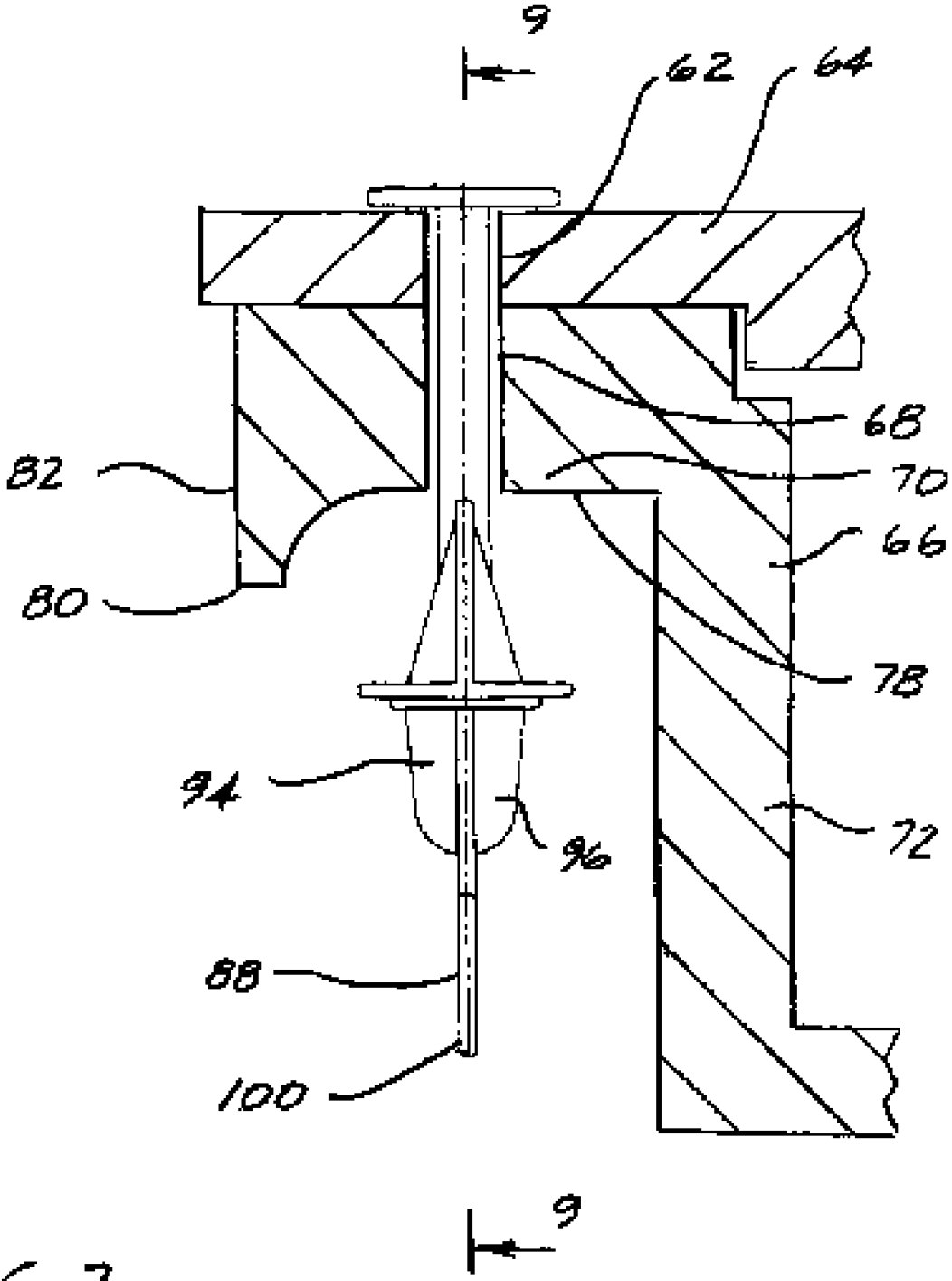
FIG. 7 is a side elevation view of the tote box seal of FIG. 1 shown in use sealing a tote box with portions of the tote box shown in section.
Figure 8:
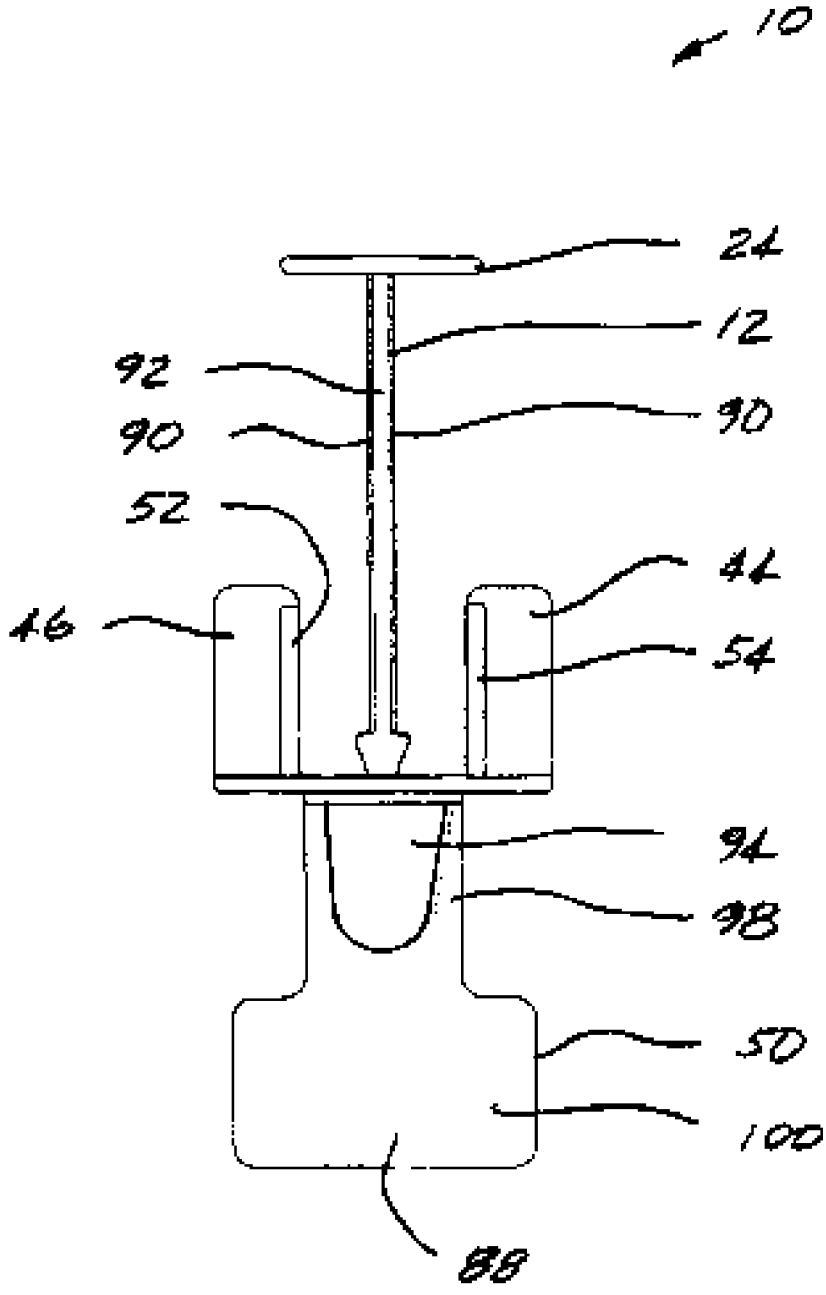
FIG. 8 is a front elevation view of the tote box seal of FIG. 7, with the tote box seal shown in use and shown removed from the tote box.

As is best shown in FIGS. 7 and 9, during use the post 12 passes through the aperture 62 in the top cover 64 of the tote box 66 and then through aperture 68 in the flange 70 which projects from the body 72 of the tote box 66. As is best shown in FIG. 9, the tops 74 and 76 of the two upwardly directed flanges 44 and 46 are spaced slightly apart from the underside 78 of the flange 70 which leads to the tote box handle 82. The upwardly directed flanges 44 and 46 bring the base portion 40 of the housing member 14 to a point at or below the lower edge 80 of the handle 82 of the tote box 66 which projects from the flange 70, as is shown in FIGS. 7 and 9. The upwardly directed flanges 44 and 46 also serve to bring the flag portion 86 to a point below the lower edge 80 of the handles 82 thereby facilitating full visual access to the surface 88 of the flag 100.

To remove the seal 10, the seal 10 is pushed upward from the bottom in the direction shown by the arrow 6 in FIG. 9 and the intermediate portion 20 of the post member 12 is cut. A minor clearance 168 is provided between the tote box 66 and the flanges 44 and 46 to facilitate authorized cutting of the portion 20 of the post 12 to remove the seal 10. The flanges 44 and 46 prevent the top cover 64 to be lifted to enable tampering with the contents of the tote box 66.

The above specified embodiment of the present invention as set forth in the specification is for illustrative purposes only. Various deviations and modifications may be made within the spirit and scope of this invention without departing from the main theme thereof.

What is claimed is:

1. A tote box seal for sealing a tote comprising:

a post member comprising:

a body portion having an extended length and having a first end, an intermediate portion and a second end;

a cap portion formed on said first end;

an enlarged end portion formed on said second end, and a locking member comprising a ring portion and downwardly projecting locking fingers defining a restricted passage, a housing receiving the locking member and comprising:

a base portion;

two upwardly projecting flanges disposed on said base portion, the flanges being parallel to one another and each flange defined by a first and second major surface on opposite sides of the flange, a pair of stiffeners formed on each of the two upwardly projecting flanges, the stiffeners of each pair arranged perpendicularly to and disposed on respective first and second major surfaces of each flange, and a downwardly projecting flange disposed on said base portion, wherein a post member in a sealing opposition traverses between the two upwardly projecting flanges, is inserted through the restricted passage of the locking member, and the enlarged end portion captured by the locking fingers.

2. The tote box seal as claimed in claim 1 further comprising:

an aperture portion formed on said base portion leading to said at least two locking fingers.

3. The tote box seal as claimed in claim 1 wherein said enlarged portion comprises:

a generally bulbous portion.

4. The tote box seal as claimed in claim 1 wherein said enlarged end portion comprises:

a rounded portion.

5. The tote box seal as claimed in claim 1 wherein said base portion comprises:

a generally diamond-shaped portion.

6. The tote box seal as claimed in claim 1 further comprising:

a generally cylindrical portion disposed adjacent said enlarged end portion of said post member.

7. The tote box seal as claimed in claim 6 further comprising:

said generally cylindrical portion having a transverse dimension smaller than said enlarged end portion.

8. The tote box seal as claimed in claim 1 further comprising:

said intermediate portion of said post member having an X cross-section.

9. The tote box seal as claimed in claim 1 with said downwardly projecting flange comprising:

a flat portion.

10. The tote box seal as claimed in claim 1 with said cap portion comprising:

a flat portion.

11. The tote box seal as claimed in claim 1 wherein said plurality of locking fingers comprises:

three locking fingers.

12. The tote box seal as claimed in claim 1 further comprising:

a bead portion formed on said housing and disposed locking said locking member and said housing together.

13. The tote box seal as claimed in claim 1 wherein said bead portion comprises:

a thermally formed bead portion.

14. The totebox seal as claimed in claim 1 wherein said housing further comprises:

a cup portion disposed enclosing said plurality of locking fingers.

* * * * *